United States Patent [19]

Miller

[11] 4,232,989

[45] Nov. 11, 1980

[54] CAM ACTUATED RAILWAY HOPPER CAR DOOR OPERATING MECHANISM

[75] Inventor: Roy W. Miller, Highland, Ind.

[73] Assignee: Pullman Incorporated, Chicago, Ill.

[21] Appl. No.: 901,953

[22] Filed: May 1, 1978

[51] Int. Cl.[3] ..... B61D 7/08; B61D 7/18; B61D 7/30

[52] U.S. Cl. ..... 414/387; 105/241.2; 105/251; 105/255; 105/308 B; 105/308 P; 414/378

[58] Field of Search ..... 105/240, 241 C, 253, 105/255, 251, 308 R, 308 P, 241.2, 308 B; 292/24, 25, 332; 414/387, 388, 378

[56] References Cited

U.S. PATENT DOCUMENTS

| | | | |
|---|---|---|---|
| 789,155 | 5/1905 | Kiesel, Jr. | 105/255 |
| 1,266,630 | 5/1918 | Ross et al. | 414/387 |
| 1,536,268 | 5/1925 | Rasmussen | 292/25 |
| 1,574,023 | 2/1926 | Crompton et al. | 292/24 |
| 1,631,758 | 6/1927 | Rasmussen | 292/24 |
| 1,686,590 | 10/1928 | Wine | 105/308 R |
| 2,696,999 | 12/1954 | Rop | 292/332 |
| 3,631,814 | 1/1972 | Shaver | 105/241 C X |
| 4,051,960 | 10/1977 | Raksanyi | 414/387 |
| 4,138,948 | 2/1979 | Korolis | 105/255 X |

*Primary Examiner*—Howard Beltran

*Attorney, Agent, or Firm*—Richard J. Myers; Stephen D. Geimer

[57] ABSTRACT

A door operating mechanism for a bottom dump railway hopper car including a plurality of longitudinally mounted, divergently opening discharge doors held in the closed position by a plurality of longitudinally spaced claw-like latches. Each pair of transversely opposite latches includes operating rods connecting each latch to a bell-crank positioned beneath the longitudinal hood of the car. The bell-cranks are operatively connected to a longitudinally disposed tension rod, which includes linkages at either end for actuation of the mechanism by trackside mounted cams.

21 Claims, 8 Drawing Figures

CAM ACTUATED RAILWAY HOPPER CAR DOOR OPERATING MECHANISM

BACKGROUND OF THE INVENTION

1. Field of the Invention

This invention pertains to railway hopper vehicles and particularly to door operating mechanisms for longitudinally disposed bottom discharge doors.

2. Description of the Prior Art

The prior art discloses several latching devices employing claw-like latches similar to those of the subject invention. The subject invention presents a novel arrangement of clawlike latches and other components for use in a railway hopper car discharge mechanism. It improves upon the prior art by providing a mechanism which latches and then draws closed the discharge gates, providing an effective seal and overcoming the problem of warped or ill-fitted discharge doors to provide continued dependable service.

SUMMARY OF THE INVENTION

The door operating mechanism of the present invention is suitable for use on a center-sill, side dump railway hopper car with longitudinally mounted discharge doors. The mechanism is situated beneath the center hood of the car and includes a tension rod disposed along the longitudinal center-line of the car beneath the center sill. The tension rod is operatively connected to a plurality of bell cranks, each of which operates two transversely opposite latches. Each latch comprises a pair of hook-shaped members horizontally guided between a pair of vertical stop members or dowel pins. Each pair of hook-shaped members act together to engage a vertically disposed latch catch or blade rigidly affixed to the bottom edge of the discharge door. Operating rods connect each bell-crank with its corresponding latches, each pair of oppositely opening doors having two bell crank assemblies with two latch mechanisms per door. The operative rods are disposed in such a manner as to be in an over-center position with respect to the bell cranks when in the closed position ensuring positive locking of the doors.

Each end of the longitudinal tension rod is connected by a suitable linkage to an operating mechanism actuated by a trackside cam. The linkages include a spring-tensioned flexible element so that operation of the tension rod by one of the linkages is not affected by the other linkage.

DESCRIPTION OF THE PREFERRED EMBODIMENT

Figure 1:
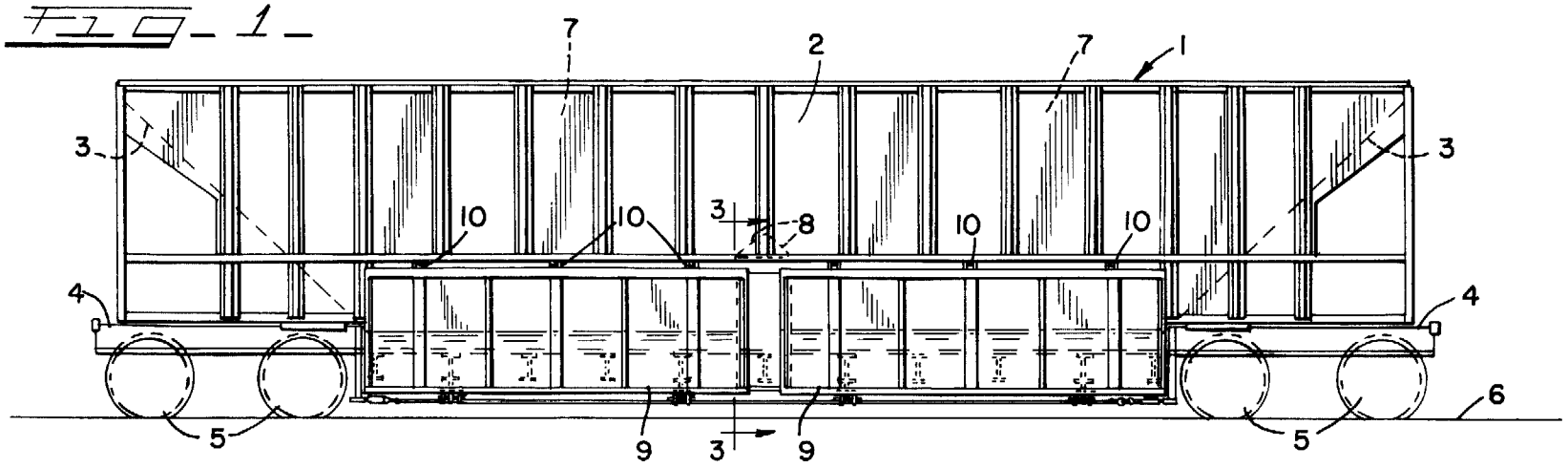
FIG. 1 is a side-elevational view of a railway hopper having longitudinal bottom discharge doors in the closed position.

Referring to FIG. 1, a railway hopper car 1 is shown including the usual transversely spaced side walls 2 and assoicated end slope sheets 3. The hopper car 1 includes longitudinally extending center sill 4 and is supported by the usual wheeled trucks 5 which ride on tracks 6. The interior of the car 1 is divided into two longitudinally spaced hoppers 7 divided transversely at the center of the car by center crossridge partitions 8. Each hopper 7 includes two oppositely opening longitudinal discharge gates or doors 9 which are connected by door hinges 10 to longitudinally extending side sills 11 for divergent opening movement.

Figure 2:
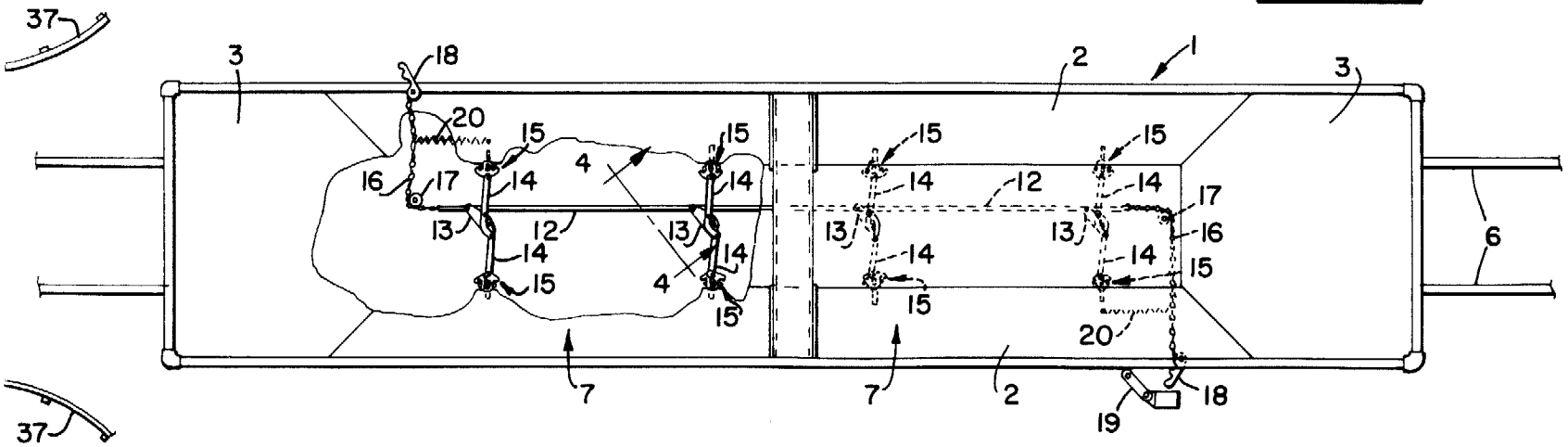
FIG. 2 is a plan view in partial cutaway of a railway hopper showing the operative components of the present invention.

Referring to FIG. 2, the operative components of the present invention are shown in place in hopper car 1. Longitudinally extending actuating or tension rod 12 is shown positioned beneath the hoppers 7. Tension rod 12 is pivotally connected to bell cranks 13 which are spaced longitudinally beneath the hoppers 7. Operating rods 14 connect each bell crank 13 with its respective latch mechanisms 15. At each end of tension rod 12 is attached a partially slack flexible linkage 16 which extends around a rotatable sheave 17. Flexible linkages 16 are also each connected to a tension lever 18 capable of pulling on flexible linkage 16 when lever 18 is engaged by trackside cam 19. Tension springs 20 are adjusted to permit independent operation of tension rod 12 from either end of the car without affecting operability from the other end of the car.

Figure 3:
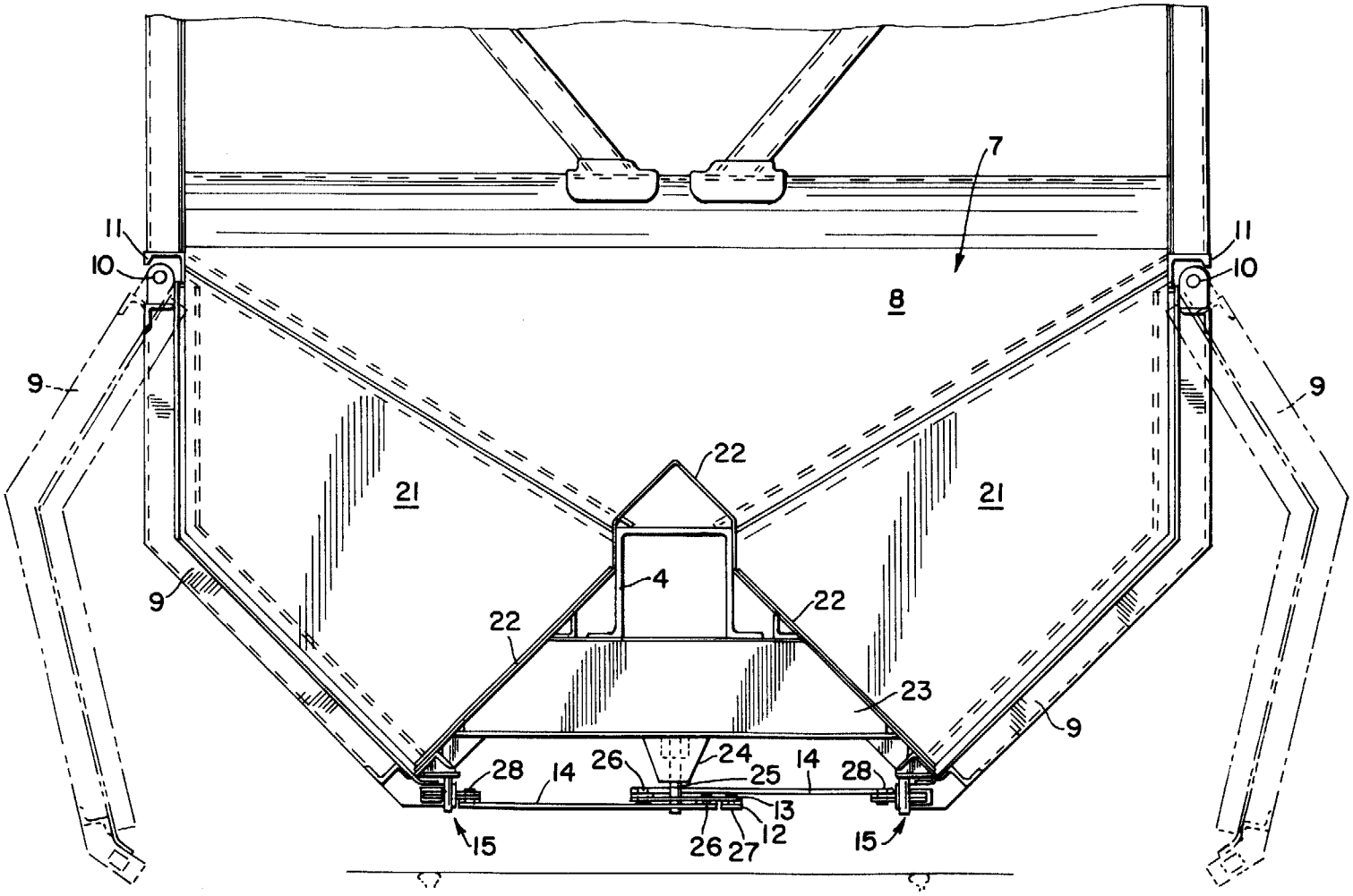
FIG. 3 is a transverse fragmentary sectional view taken substantially along lines 3—3 of FIG. 1.
Figure 4:
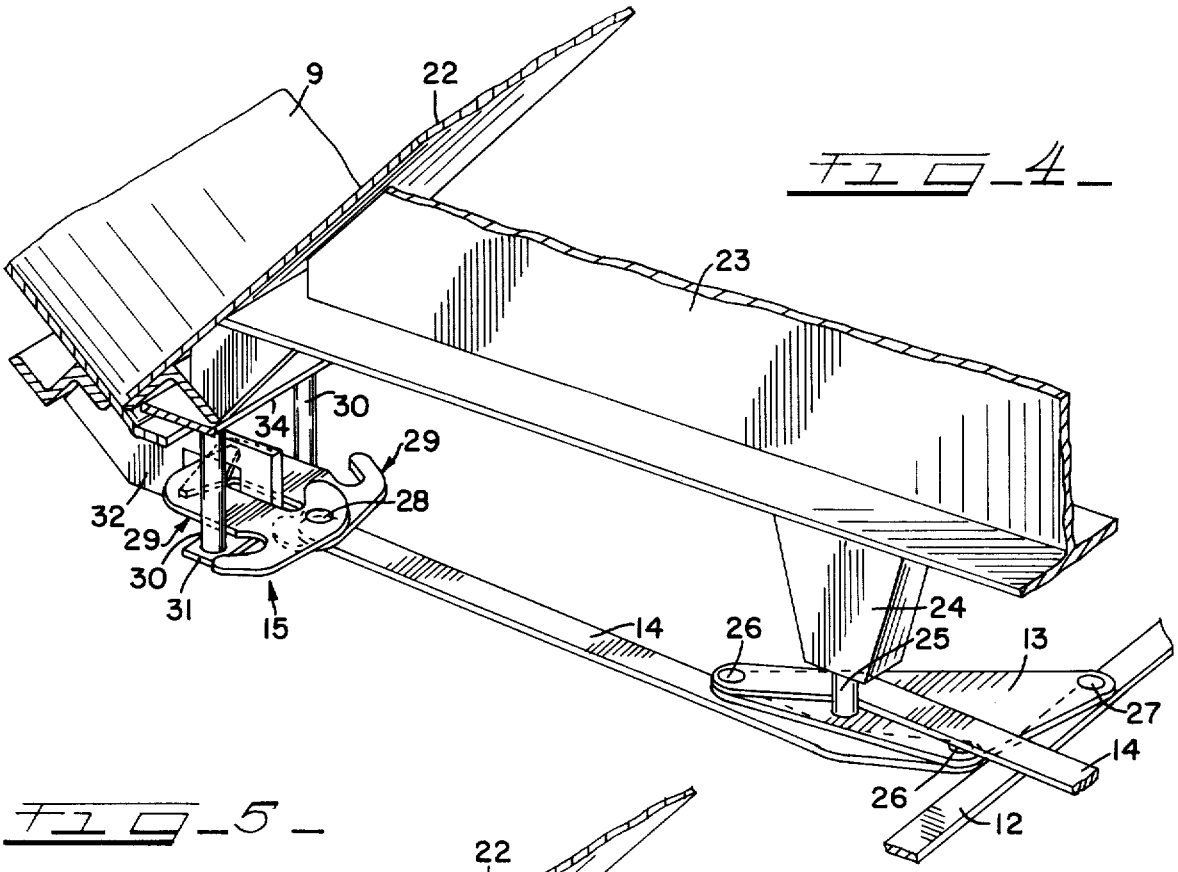
FIG. 4 is a perspective view of the latching mechanism of the present invention in the closed position taken substantially along lines 4—4 of FIG. 2.
Figure 5:
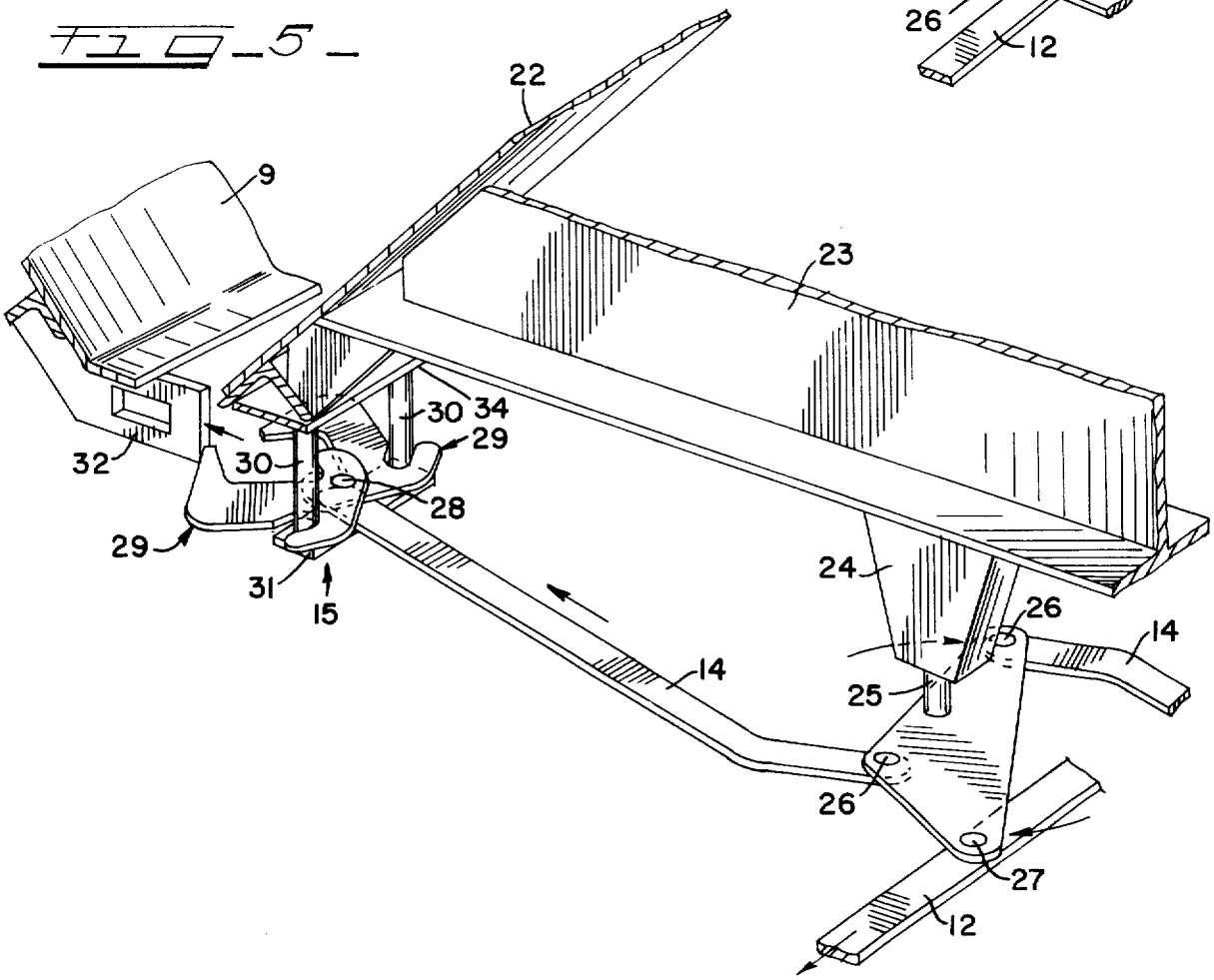
FIG. 5 is a perspective view of the latching mechanisms of the present invention in the open position taken substantially along lines 4—4 of FIG. 2.

Referring to FIG. 3, the position of the latch mechanisms 15 and their respective bell crank 13 is shown relative to discharge doors 9. The articulated shape of discharge doors 9, together with partition sheet 8, cross-ridge slope sheets 21, end slope sheet 3 (not shown in FIG. 3) and longitudinal hood 22 define the shape of hopper 7. Center sill 4 is disposed beneath the longitudinal hood 22, and cross-ridge 23 is positioned thereunder. Cross-ridge 23 supports bell crank bracket 24 from which extends bell crank pivot 25. As best shown in FIGS. 3,4 and 5 bell crank 13 is pivotally supported by bell crank pivot 25. Tension rod 12 is pivotally connected to bell cranks 13 by tension rod pivots 27. Operating rods 14 are pivotally connected to bell crank 13 by rod pivots 26 and extend transversely outward therefrom.

Each operating rod 14 is pivotally connected to each latch mechanism 15 by means of latch pivot 28. Each latch mechanism 15 includes a latch hanger plate or saddle 34, two vertically disposed stop members or latch dowel pins 30 extending down and supported therefrom, two hook-shaped members generally designated as 29 horizontally movably disposed between pins 30, a latch support plate 31 rigidly attached to the lower ends of pins 30, and a vertically disposed latch catch or blade 32 rigidly affixed to the discharge door 9.

FIG. 4 shows the latching mechanism of the present invention in the closed and locked position. Latch blade 32 is positively engaged by hook-shaped members 29 thereby securing discharge door 9 in a closed position. Operating rods 14 are held in the locked position due to the overcenter configuration of rod pivots 26 relative to bell crank pivot 25.

FIG. 5 illustrates the operation of the present invention as it moves to the open position. Tension rod 12 moves in the direction indicated by the arrow, causing bell crank 13 to rotate as indicated. Operating rods 14 and rod pivots 26 move out of their overcenter configuration, the rotation of bell crank 13 causing rods 14 to move divergently outward. As each operating rod 14 moves outward, it acts through latch pivot 28 to move hook-shaped members 29 outward between stop members or dowel pins 30. As members 29 move outward, each engages one of the dowel pins 30, stopping the outward movement of members 29 and causing them to divergently rotate about dowel pins 30. As members 29 continue to open, latch blade 32 is disengaged, allowing discharge door 9 to swing open.

Figures 6, 7, 8:
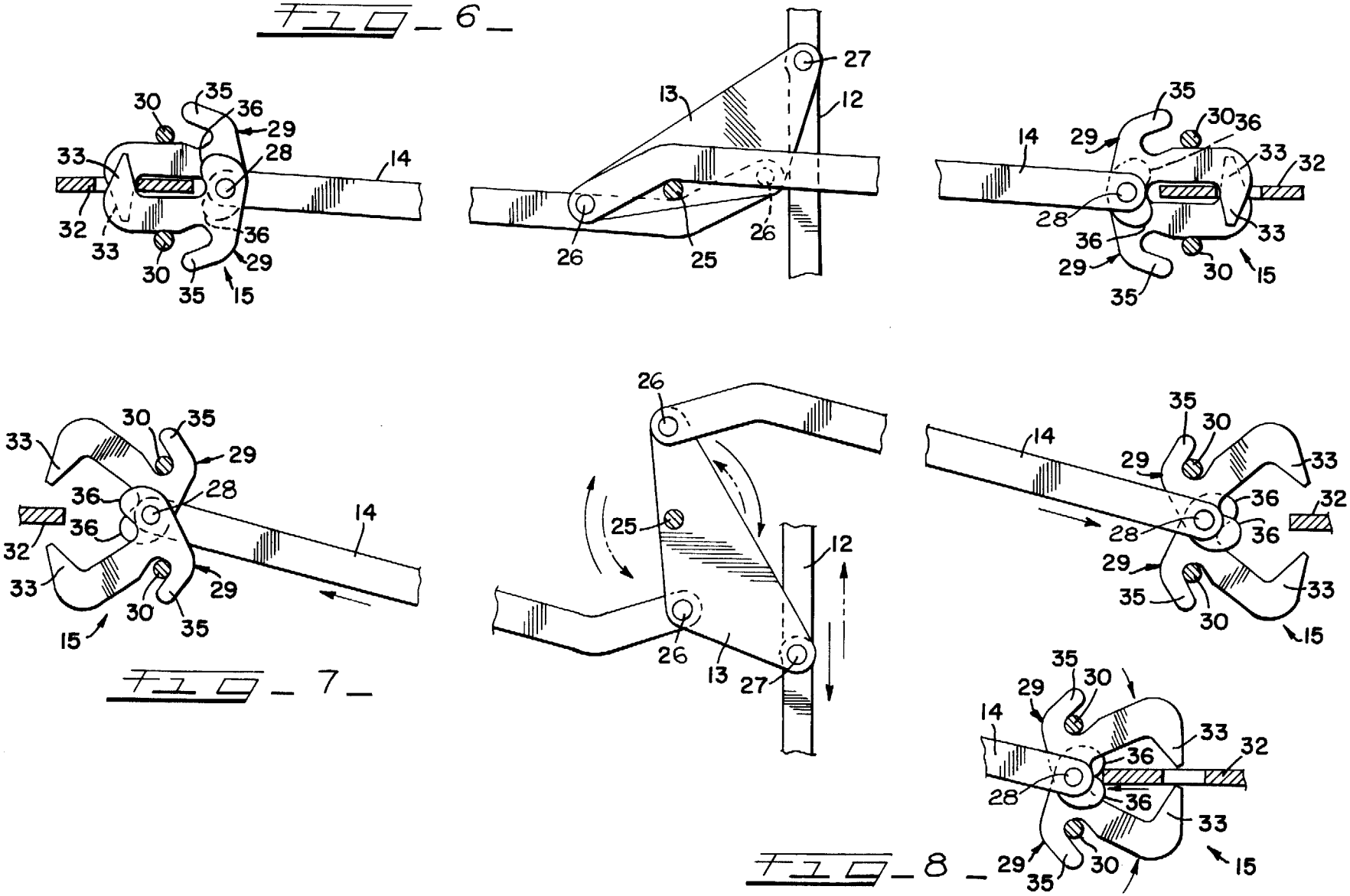
FIG. 6 is a fragmentary plan view of the latching mechanisms of the present invention in the closed position.
FIG. 7 is a fragmentary plan view of the latching mechanism of the present invention in the open position.
FIG. 8 is a fragmentary plan view of one of the latches of the present invention.

FIGS. 6 and 7 illustrate the configuration of the latch mechanism in the closed and open positions, respectively. The overcenter locked configuration of rod pivots 28 relative to bell crank pivot 25 is best shown in FIG. 6.

FIGS. 6, 7 and 8 all show the various reactive portions of hook-shaped members 29. Each member 29 includes a latch keeper 33, a dowel pin arm 35 and a latch lobe 36.

As best shown in FIG. 7, movement of tension rod 12 in the direction of the solid arrow rotates bell crank 13 as indicated. This causes operating rods 14 and hook-shaped members 29 to move outward. As members 29 move outward the dowel pin arm 35 of each member 29 engages one of dowel pins 30, which acts to stop further outward movement of members 29. As operating rods 14 continue to move outward, members 29 are caused to rotate about dowel pins 30. This action causes each pair of members 29 to divergently open, disengaging latch blade 32 from latch keepers 33, allowing gravity to open the discharge doors of the hopper car.

FIG. 8 illustrates the action of the latch mechanisms as the discharge doors close. As the doors are moved to the closed positions by means of suitable converging door closing cams 37 (shown in FIG. 2), latch blade 32 pushes against latch lobes 36 of hook-shaped members 29. This action causes members 29 to convergently rotate, causing latch keepers 33 to again engage and secure latch catch or blade 32. Tension rod 12 is now moved in the direction indicated by the phantom arrow in FIG. 7, rotating bell crank 13 as shown by the phantom arrows. Operating rods 14 and members 29 are drawn toward the center-line of the car, thereby securing positive engagement of latch blades 32 by latch keepers 33 of members 29. Operation is complete when rod pivots 28 return to their overcenter configuration relative to bell crank pivot 25 as shown in FIG. 6.

OPERATION

As loaded railway hopper car 1 travels along tracks 6, a trackside cam 19 is engaged by tension lever 18. Rotation of tension lever 18 causes flexible linkage 16 to pull on tension rod 12. Movement of tension rod 12 produces simultaneous rotation of all bell cranks 13. As each bell crank 13 rotates, operating rods 14 are moved out of their overcenter locking configuration and continue to move away from the center line of the car. As each operating rod 14 moves outward, it moves its pair of hookshaped members 29 outward also, until dowel pin arm 35 of each member 29 engages one of stop members or dowel pins 30. Upon engagement, the outward movement of members 29 is stopped, and as each operating rod 14 continues to move outward, each member 29 rotates about one of the dowel pins 30, causing latch keepers 33 to divergently open, releasing latch catches or blades 32 and allowing gravity to swing discharge doors 9 open.

As the railway hopper 1 continues to move along tracks 6, discharge of the lading is completed, and discharge doors 9 are moved back to the closed position as they engage converging door closing cams 37, mounted along the track. As doors 9 are closed, each latch blade 32 engages the latch lobes 36 of its respective latch mechanism 15. As door cams 37 push inward on doors 9, each latch catch or blade 32 pushes inward on latch lobes 36, causing hook-shaped members 29 to convergently rotate about dowel pins 30, bringing latch keepers 33 into positive engagement with each latch catch 32.

As the railway hopper 1 continues along tracks 6, another tension lever 18 is caused to rotate by means of a trackside cam (not shown), acting through a flexible linkage 16 to cause tension rod 12 to move to the closed position. As tension rod 12 moves, all of bell cranks 13 are simultaneously rotated causing operating rods 14 to move inward, drawing hook-shaped members 29, latch blades 32 and discharge doors 9 toward the center line of the car. As tension rod 12 completes its closing movement, bell cranks 13 rotate back to their closed and locked position, and operating rods 14 are again in an overcenter locking configuration. The discharge cycle is now complete, with operating rods 14 and members 29 securely holding discharge gates 9 closed and locked.

What is claimed is:

1. For a railway hopper car having an underframe and a longitudinally extending discharge door hingedly mounted on the car for movement laterally outward from a closed to an open position relative to a hopper having a discharge opening, an improved door operating mechanism comprising:

a longitudinal actuating rod extending beneath and carried by the underframe of said car, means for longitudinally displacing said rod, a bell crank pivotally mounted to the underframe for rotation about a generally vertical axis, said bell crank pivotally connected to said rod for rotation in response to longitudinal displacement of said rod, an operating rod, supported on said car having first and second ends, said first end being pivotally connected to said bell crank and said operating rod extending transversely therefrom for generally reciprocating movement in response to rotation of said bell crank, a pair of vertically disposed stop members rigidly mounted to the bottom of said hopper adjacent to said discharge opening and positioned laterally outward of said bell crank, horizontally disposed latch means supported between said stop members having a pair of hook-shaped members pivotally interconnected with each other and with said second end of said operating rod, a latch catch rigidly affixed to said discharge door, engageable by said hook-shaped members for maintaining said door in a closed position, and said hook-shaped members each including an arm appending laterally therefrom engagable by a respective stop member for pivoting said hook-shaped members relative to the second end of said operating rod in response to reciprocating movement of said operating rod, said members pivoting between a locked position between said stop members wherein said members operatively associate with each other and engage said latch catch in grasping relation and an unlocked position wherein said members are disengaged from said latch catch by said arms engaging said respective stop members.

2. The invention in accordance with claim 1, said means for longitudinally displacing said actuating rod comprising:

a tension lever pivotally mounted on said car and engagable by said track side cam, a sheave pivotally mounted to the underframe of said car for rotation about a generally vertical axis, and a flexible linkage extending from said tension lever to said actuating rod and passing about said sheave whereby engagement of said tension lever by an associated trackside cam causes said flexible linkage to pull on and longitudinally displace said actuating rod.

3. The invention in accordance with claims 1 or 2, wherein said first end of said operating rod is maintained in overcenter locking relationship relative to said bell crank pivotal mounting when said mechanism is in the closed position.

4. The invention in accordance with claim 2, including a tension spring connected to said flexible linkage and anchored to said car whereby tension is maintained in said flexible linkage.

5. The invention in accordance with claim 4, wherein said car has means for longitudinally displacing said actuating rod at both ends of the rod, each being operable from an opposite side of said car.

6. The invention in accordance with claim 1, wherein said discharge door is moved from an unloading open position to a latch-engaging closed position by means of a trackside door closing cam.

7. In a railway car having a hopper and a hingedly mounted discharge door for movement between a closed and an open position relative to a discharge opening for the hopper, a door operating mechanism comprising:

an operating rod supported on said car selectively reciprocable between open and closed positions, movable generally transversely to the bottom edge of said hopper, said rod having an end in the vicinity of the bottom edge of said hopper, support means extending perpendicularly generally downward from the bottom edge of said hopper and adjacent to said discharge opening having a pair of spaced generally parallel stop members, said end of said operating rod being reciprocable along a path passing generally midway between said stop members and generally perpendicular to the plane of said stop members, a latch catch rigidly affixed to the bottom of said discharge door, latch means supported by said support means and pivotally connected to the end of said rod for reciprocating movement in conjunction therewith, said latch means including a pair of pivotally interconnected hook-shaped members, each hook-shaped member including a latch keeper at its outer end and an arm extending from the keeper and engageable by one of said stop members whereby said hook-shaped members are rotated in opposite directions relative to the end of said operating rod between latch catch engaging and disengaging positions in response to the reciprocating movement of said operating rod, and each hook-shaped member having a latch lobe engageable by a portion of said latch catch whereby said latch keepers are urged toward each other to a latch catch grasping and engaging position about the latch catch in response to said discharge door being moved from an open toward a closed position, said latch means being disposed between said stop members such that said latch catch is drawn in between said stop members after engagement by said latch keepers in response to said operating rod moving into a closed position.

8. The invention in accordance with claim 7, including selectively rotatable means pivotally mounted to said car and pivotally connected to said operating rod for moving said rod between open and closed positions.

9. The invention in accordance with claim 8, wherein said operating rod is held in on overcenter locking position relative to the pivotal mounting of said rotatable means when said rod is in the closed position.

10. The invention in accordance with claims 7 or 9, wherein said discharge door is moved from an open to a closed position by means of a trackside door closing cam.

11. For a railway hopper car having a hopper with a bottom discharge opening and a door pivotally mounted on said car for movement between a closed position covering said discharge opening and an open position away from said opening, an improved door operating mechanism comprising:

latching means mounted on said hopper adapted to engage and retain associated latch catch means mounted on said door, thereby maintaining said door in a closed position, said latching means including a pair of pivotally interconnected hook members supported on said hopper moveable between a locked position wherein said hook members engage each other and the associated latch catch means in grasping relation thereby retaining the latch catch means and an unlocked position wherein the latch catch means is disengaged, reciprocating means pivotally connected to said hook members for moving said hook members between locked and unlocked positions, said hook members each including an arm appending laterally therefrom, and said latching means further including a pair of stop members mounted on said hopper, each stop member being adapted to respectively engage one of said hook members and said arms as said hook members are moved between locked and unlocked positions thereby causing said hook members to pivot in opposite directions relative to said reciprocating means to lock and open the hook members.

12. The invention in accordance with claim 11, wherein each of said hook members further include lobe means, said lobe means being engageable by said latch catch means to move said hook members toward said locked position with each other and said latch catch means.

13. The invention in accordance with claim 11 or 12, wherein said stop members comprise a pair of spaced generally parallel pins mounted on said hopper and extending generally downwardly therefrom, and a saddle portion extending between and connecting with said pins and slidably supporting said hook members thereon for sliding movement of the hook members between said pins.

14. The invention in accordance with claim 11, and a bell crank having a pivotal mounting on the car, said reciprocating means comprising a member having a first end pivotally connected to said hook members and having a second end pivotally connected with the bell crank, and means for rotating said bell crank about the pivotal mounting on said car thereby reciprocating said reciprocating member.

15. The invention in accordance with claim 14, wherein said second end of said reciprocating member is positionable in overcenter locking relationship relative to said bell crank pivotal mounting when said hook members are engaged.

16. The invention in accordance with claim 14, wherein said reciprocating member extends generally transversely of the longitudinal centerline of said car and said bell crank pivotal mounting is about a generally vertical axis, said means for rotating said bell crank comprise a generally longitudinally extending actuating member pivotally connected to said bell crank, and means for longitudinally displacing said actuating member.

17. The invention in accordance with claim 16, wherein, said means for displacing said actuating member includes a lever mounted on said car being engageable by an associated trackside cam, and a flexible linkage connected with and extending between said lever and said actuating member whereby said actuating member is displaceable attendant to engagement of said lever by said associated trackside cam.

18. The invention in accordance with claim 11, wherein said stop means are adapted to engage and draw said hook members toward the latch catch means as said hook members move from the disengaged unlocked position to the engaged locked position.

19. For a railway hopper car having a hopper with a bottom discharge opening and a door pivotally mounted on said car for movement between a closed position covering said discharge opening and an open position away from said opening, an improved door operating mechanism comprising:

latch catch means mounted on the door, latching means mounted on said hopper adapted to engage and retain latch catch means for securing said door in the closed position, said latching means including hook means supported on said hopper and being graspingly engageable in claw like manner with the catch means and retaining said catch means in an engaging door locked position, said hook means having arm means laterally appending therefrom, said latching means further including stop means supported on said hopper, said stop means being adapted to engage said hook means and appending arm means, and reciprocating operating means pivotally attached to said hook means for moving said hook means between the latch catch means engaging door locked position and a latch catch means disengaging door unlocked position, said arm means engaging said stop means as said hook means are moved toward a latch catch means disengaging position thereby pivoting said hook means relative to said reciprocating means.

20. The invention in accordance with claim 19, wherein said hook means further comprises a pair of hook members pivotally interconnected with said reciprocating means adapted to interengage each other and said door-mounted latch catch means in grasping relation for securing the door in the closed position.

21. The invention in accordance with claim 19, wherein said stop means comprise a pair of spaced generally parallel stop pins disposed about said hook members, and said arm means comprising an arm appending from each of said hook members engageable with a respective stop pin.

* * * * *